United States Patent [19]

Hudson

[11] 4,094,215

[45] June 13, 1978

[54] PLIER WRENCH

[76] Inventor: Robert H. Hudson, 103 Valley St., Seekonk, Mass. 02771

[21] Appl. No.: 783,816

[22] Filed: Apr. 1, 1977

[51] Int. Cl.[2] ..... B25B 13/14; B25B 13/22

[52] U.S. Cl. ..... 81/127; 81/133; 81/136

[58] Field of Search ..... 81/130 R, 130 A, 126, 81/127, 133, 131, 136, 356, 358

[56] References Cited

U.S. PATENT DOCUMENTS

| | | | |
|---|---|---|---|
| 1,216,224 | 2/1917 | Furgerson | 81/127 |
| 1,244,966 | 10/1917 | Eifel | 81/126 |
| 1,367,711 | 2/1921 | Nortwed | 81/127 X |
| 2,156,529 | 5/1939 | Day | 81/127 |
| 2,397,095 | 3/1946 | Emmett | 81/358 X |

*Primary Examiner*—James L. Jones, Jr.
*Assistant Examiner*—Nicholas P. Godici
*Attorney, Agent, or Firm*—Barlow & Barlow

[57] ABSTRACT

A plier wrench is provided which has a body with a fixed jaw and a movable jaw slidable relative thereto that carries a rack. A gear engages the rack and moves the movable jaw and in addition a pivotal handle or lever is provided which may be swung toward the main handle or body portion which lever carries a tab that engages and rotates the gear to move the movable jaw toward the fixed jaw.

2 Claims, 4 Drawing Figures

PLIER WRENCH

BACKGROUND OF THE INVENTION

There have been a number of pliers which have jaws, one of which can be moved parallel to the other jaw and locked in a closed position. Primarily these are toggle action pliers of a type that are exemplified by U.S. Pat. No. 3,195,382. With pliers of this toggle type, the jaws do not stay parallel at all positions, a condition which is not always advantageous in utilizing such type of toggle link pliers. There have also been proposed certain parallel jaw type wrenches in which the jaws operate with racks, such as, for example, illustrated in U.S. Pat. No. 3,257,878. In effect, the instant invention is a combination of plier action in which squeezing the body and pivotal lever together tend to grip the object, and of a parallel jaw type wrench. The construction obviates release systems that need to be designed for conventional toggle wrenches and improves upon the adjustable wrench, such as the open end wrench with the ratchet type adjustment, in that it provides a clamping action.

SUMMARY OF THE INVENTION

The plier wrench of this invention provides a wrench having a pair of plier-like handles, one handle having a stationary jaw and the second handle being pivoted to the first and connected through a gear to a movable jaw. The second handle serves to close the jaws by having a tab connected therewith that engages a gear which in turn rotates the gear and slides the movable jaw. The arrangement is such that the gear protrudes from the side edge of the fixed handle as well as a portion of the tab juxtaposed thereto so that a thumb may operate the gear and also disengage the tab from the gear.

It is therefore an object of this invention to provide an adjustable plier wrench with a release mechanism that not only will easily release the engagement of the part engaged but also will provide for slidable movement of the movable jaw.

The wrench is basically a combination of toggle action pliers and parallel jaw pliers in which the jaw position is infinitely variable.

DESCRIPTION OF THE PREFERRED EMBODIMENT

Figure 1:
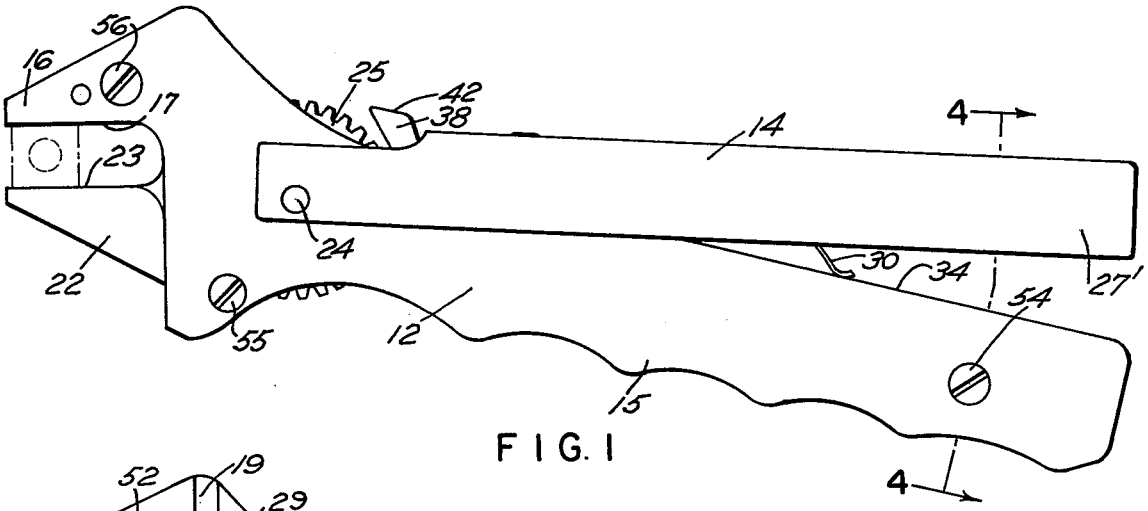
FIG. 1 is a plan view of the wrench of this invention showing the jaws engaged with an object.
Figure 2:
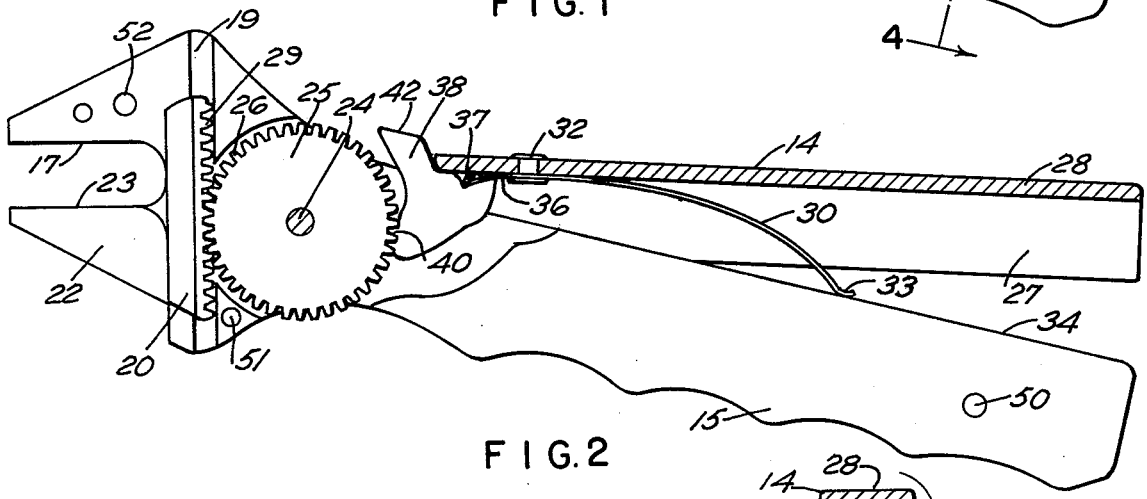
FIG. 2 is a view in section showing the wrench in the same position.
Figure 4:
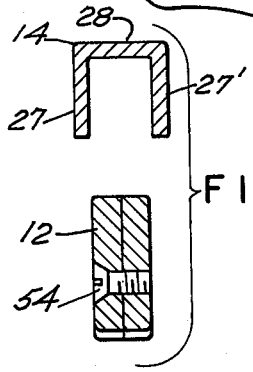
FIG. 4 is a section on substantially line 4—4 of FIG. 1.

Referring to the drawings the plier wrench of this invention, which is illustrated in FIGS. 1 and 2, comprises a first handle or elongated body portion designated 12 and a second handle or lever portion designated 14. The first handle unit or body portion 12 has scalloped portions as at 15 to allow for one to wrap one's fingers therearound and this handle section containing the scalloped portions extends into the jaw section where a fixed jaw 16 is provided, which jaw has a flat face 17. For convenience in manufacture the elongated body portion consisting of the handle section with the scalloped portion 15 and the jaw 16 may be formed of two mating pieces which are split longitudinally. When split apart and the top face removed therefrom, the lower section will be as seen in FIG. 2. Internally, therefore, the upper portion of the body a transverse groove 19 is formed and received in this groove is the rack portion 20 of the movable jaw 22 which has a face 23 thereon. Additionally, a pivot pin 24 rises through the body portion and rotatably mounted about this pin is a gear 25. The gear 25 has teeth 26 which engage mating teeth 29 on the rack 20 and additionally received on the pivotal pin 24 is the channel-shaped lever 14. As will be seen more particularly in FIG. 2, the lever 14 has a general U shape consisting of side walls 27, 27' joined by a base wall 28, the spacing being such as to embrace the handle portion of the body when compressed thereover as seen more particularly in FIG. 3.

The lever 14 is provided with a spring member 30 which is riveted thereto as at 32. The spring member 30 has an outwardly turned portion as at 33 which slidably engages a wall 34 of the body member and particularly the handle portion thereof and extends beyond the rivet 32 so as to have a protruding portion 36 to which there is rivetably attached as at 37 a tab 38. The tab 38 has a gear engaging portion 40 and a thumb portion 42 which thumb portion protrudes beyond the wall 28 of the lever 14. The tab 38, as can be readily appreciated, may effectively be disengaged from the gear 25 by pressing the portion 42 downwardly as seen in FIG. 3 in which case the gear-engaging portion 40 will move away from the gear teeth.

Figure 3:
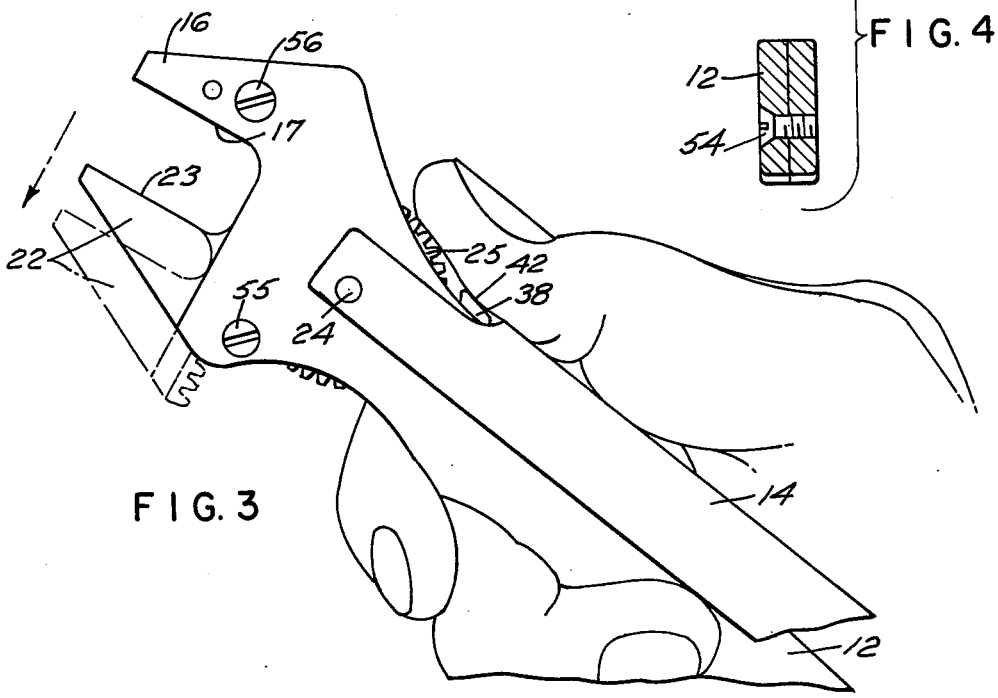
FIG. 3 is a diagrammatic view showing the manner in which the movable jaw may be adjusted with the thumb of the user.

The manner in which the plier wrench operates can be seen by viewing FIG. 3 where the diagrammatic arrangement for using the wrench has been illustrated. As will be seen, the thumb of an operator can readily engage the protruding teeth of the gear 25 while at the same time depress the portion 42 of the tab 38 so that the gear indeed may be rotated. When the gear is rotated, the movable jaw 22 can be moved outwardly by rotating the gear 25 counterclockwise as seen in FIG. 3 to the broken line position. In order to rotate the gear, the thumb at the same time will automatically depress the portion 42 of the locking tab. With the movable jaw 22 moved away as seen in broken lines, it can be readily appreciated that the thumb can likewise move the gear clockwise without necessarily depressing the tab 38 as seen in FIG 3 so that the movable jaw 22 will move towards the fixed jaw 16 and be able to engage the head of a nut or any other object which is desired to be engaged. Upon releasing the lever or second handle unit 14 away from the fixed handle unit, the jaw faces 17 and 23 will move apart due to the movement of the tab 38 in rotating the gear. It would be appreciated that the two jaws can be moved slightly apart or together with the handles and upon squeezing the handles together, the second jaw will now move towards the first jaw and tightly engage the nut with a directly proportionately greater pressure than that pressure being exerted by the squeezing action of the hand. In this fashion the plier wrench will act much in the same fashion as do the toggle wrenches that have been previously referred to and as, for example, are seen in Patents such as Nos. 3,600,986 and 3,195,382.

As has been noted, the body portion is preferably made of two mating halves and to this end as seen in FIG. 2, the lower half could be considered as a shell which is provided with bosses 50, 51 and 52 which bosses are suitably threaded. An identical upper half may therefore be readily secured together to form an integral unit by having threaded fasteners such as 54, 55 and 56 respectively engage the bosses 50, 51 and 52. Obviously other means of forming the elongated body portion or first handle will appear to those skilled in the art.

I claim:

1. A wrench comprising an elongated body portion having a fixed jaw at one end, a movable jaw slidable in said body portion for cooperation with the fixed jaw and having a rack, a gear rotatably mounted on a pin in the body portion meshing with the rack and of a size and at a position to protrude beyond the side of the body portion, a lever pivotally mounted on said pin, said lever having a locking tab in the plane of said gear and with a thumb portion protruding beyond the side of the body portion adjacent said gear and resiliently urged into engagement with said gear so that when the lever is swung toward the body the gear rotates and the rack slides the movable jaw toward the fixed jaw, said gear and said thumb portion being exposed for simultaneous manual engagement by a single finger so that when the tab is disengaged from the gear, the gear may be manually rotated to adjust the position of the movable jaw.

2. A wrench as in claim 1 wherein the locking tab has a portion thereof protruding from the lever adjacent the gear and spring means normally urge the tab into gear engagement and spring means normally urge the lever away from the body.

* * * * *